US009424708B2

(12) United States Patent
Sun

(10) Patent No.: US 9,424,708 B2
(45) Date of Patent: Aug. 23, 2016

(54) PARKING METER

(71) Applicant: SHENZHEN HOROAD ELECTRONIC TECHNOLOGY DEVELOPMENT CO., LTD., Shenzhen, Guangdong Province (CN)

(72) Inventor: Hao Sun, Shenzhen (CN)

(73) Assignee: SHENZHEN HOROAD ELECTRONIC TECHNOLOGY DEVELOPMENT CO. Ltd., Shenzhen (CN)

( * ) Notice: Subject to any disclaimer, the term of this patent is extended or adjusted under 35 U.S.C. 154(b) by 0 days.

(21) Appl. No.: 14/766,730

(22) PCT Filed: Apr. 29, 2014

(86) PCT No.: PCT/CN2014/076476

§ 371 (c)(1),
(2) Date: Aug. 7, 2015

(87) PCT Pub. No.: WO2014/206140

PCT Pub. Date: Dec. 31, 2014

(65) Prior Publication Data

US 2015/0371483 A1 Dec. 24, 2015

(30) Foreign Application Priority Data

Jun. 26, 2013 (CN) ..... 2013 2 0369004 U
Jul. 23, 2013 (CN) ..... 2013 2 0437659 U
Aug. 26, 2013 (CN) ..... 2013 2 0500610 U

(51) Int. Cl.
*G07F 1/04* (2006.01)
*G07F 17/24* (2006.01)
*G07F 1/02* (2006.01)
*G07F 7/08* (2006.01)

(52) U.S. Cl.
CPC ..... *G07F 17/248* (2013.01); *G07F 1/02* (2013.01); *G07F 1/046* (2013.01); *G07F 7/0873* (2013.01)

(58) Field of Classification Search
CPC ..... G07F 1/02; G07F 7/0873; G07F 17/24; G07F 17/248; G07F 1/046
USPC ..... 194/347
See application file for complete search history.

(56) References Cited

U.S. PATENT DOCUMENTS

RE37,193 E * 5/2001 Ward, II ..... G07F 17/248 194/217
2003/0112151 A1* 6/2003 Chauvin ..... G06Q 20/3552 340/870.02

* cited by examiner

*Primary Examiner* — Mark Beauchaine
(74) *Attorney, Agent, or Firm* — PROI Intellectual Property US

(57) ABSTRACT

A parking meter comprises a meter base (50), a meter cover (60), and a meter mechanism (10). A coin path (20) is provided at a lower section of a front panel (11) of a shell of the meter mechanism (10), the lower section of the front panel (11) comprising a first panel (111) and a second panel (112) in a step form, the first panel (111) protruding relative to the second (112). The parking meter further comprises a slider (30) comprising an slider upper section (31) and a slider lower section (32) in a step form. A through hole (114) facilitating passing through of the slider (30) is provided on a joint wall (113) of the first panel (111) and the second panel (112) and below the coin path (20); a sliding groove (40) facilitating upward and downward sliding of the slider (30) is provided on the second panel (112).

16 Claims, 9 Drawing Sheets

M Enlarged

A-A

B-B

PARKING METER

CROSS REFERENCE TO RELATED APPLICATIONS

The present application is the US national stage of International Patent Application PCT/CN2014/076476 filed on Apr. 29, 2014, which, in turn, claims priority to Chinese Patent Application CN 201320369004.8 filed on Jun. 26, 2013, to Chinese Patent Application CN 201320437659.4 filed on Jul. 23, 2013, and to Chinese Patent Application CN 201320500610.9 filed on Aug. 26, 2013.

TECHNICAL FIELD

The present invention relates to parking fee charging management devices, and in particular, relates to a parking meter.

BACKGROUND

Parking meters, acting as a parking fee charging management tool, are basically used outdoors. During long term use, the coin path of the parking meter may be blocked by foreign substances or manually by others. In the prior art, the coin path of the parking meter is generally directly provided on the front panel of the meter mechanism of the parking meter, and the front panel and the rear panel of the shell of the meter mechanism are coupled via such a securing member as a screw. When the coin path is blocked, the cover of the meter needs to be firstly opened, and then the shell of the meter mechanism is taken out from the meter base. Since the coin path is relatively narrow, the blocking foreign substances cannot be simply cleared from the front directly, the shell of the meter mechanism needs to be opened to remove the front panel. In this way, the foreign substances in the coil path may be removed from the inner side of the front panel. Such operations for clearing the coin path are very troublesome, and meanwhile the normal working of the meter is affected.

SUMMARY

The present invention is intended to overcome the defect in the prior art, and to provide a parking meter, wherein when a coin slot of the parking meter is blocked, the clearance is very convenient.

To solve the above technical problem, the present invention employs the following technical solutions:

A parking meter is designed and used, which comprises a meter base, a meter cover, and a meter mechanism installed inside the meter base and the meter cover, wherein: a coin path is provided at a lower section of a front panel of a shell of the meter mechanism, the lower section of the front panel comprising a first panel and a second panel in a step form, the first panel protruding relative to the second panel, the coin path being provided on the first panel; the parking meter further comprises a slider, the slider comprising a slider upper section and a slider lower section in a step form; wherein a through hole facilitating passing through of the slider is provided on a joint wall of the first panel and the second panel and below the coin path; a sliding groove facilitating upward and downward sliding of the slider is provided on the second panel; a coin slot is provided on the slider upper section, the slider upper section mates with the coin path, and the slider lower section mates with the sliding groove; when the meter is assembled, the joint wall is abutted against an upper end face of the meter base, the slider lower section and the sliding groove are inside the meter base.

The slider is made from plastic, and a clip slot is provided on the slider upper section; wherein a metal block is installed in the clip slot, and the coin slot is provided in the metal block. A tail portion of the slider lower section is in a U shape, bumps being formed on outer sides of two feet of the U shape; and correspondingly, a bayonet mating with the bump is formed on a side wall of a tail portion of the sliding groove.

Wave teeth are formed on the slider lower section.

As an improvement of the present invention, the parking meter further comprises a protection door structure for protecting a card insertion opening of a POS machine, the protection door structure comprising an installation base, a protection door, and a guiding plate; wherein the installation base is in a square arch shape, is installed and secured on the front panel of the shell of the meter mechanism, and is positioned above the card insertion opening; the protection door is in an H shape, and comprises an upper shaft rod and a lower block, and an intermediate section; the upper shaft rod of the protection door is freely disposed at a top portion of the installation base; the intermediate section of the protection door is positioned inside an square arch of the installation base, and the length of the intermediate section is greater than the width of the square arch in a top-bottom direction; the guiding plate is parallel with a length direction of a card insertion slot of the POS machine, one end of the guiding plate is secured on a lateral side of the protection door, and the other end of the guiding plate extends into the interior of the meter; and the protection door is capable of moving in a top-bottom direction and rotating in an inner-outer direction relative to the installation base, and the lower block of the protection door is capable of blocking the card insertion opening.

A lower end face of the lower block of the protection door is an inverted triangle bevel or a circular arc surface.

As an improvement of the present invention, the parking meter further comprises a battery holder disposed inside the meter, a columnar battery being installed in the battery holder, the battery holder being provided with an opening for disposing or removing the battery and being provided with a battery baffle, the battery baffle further comprises an upper holding portion and a lower guiding rail portion; wherein a thick-wall portion of the battery holder at a side portion of the opening is provided with a guiding groove mating with the guiding rail portion, a battery holder wall at a distal end of the guiding groove being provided with a gap for disposing or removing the battery baffle; and the guiding rail portion of the battery baffle is slidably clamped in the guiding groove, the holding portion of the battery baffle presses and holds the battery inside the battery holder.

The guiding groove is parallel with an axial direction of the battery; and an inner side face of the holding portion of the battery baffle is an arc surface, which mates with a cylindrical surface of the battery.

The gap is provided on an upper end of the guiding groove.

As compared against the prior art, the parking meter according to the present invention achieves the following beneficial effects:

1. A wider coin path is provided and a sliding groove is configured, a coin slot is provided on a slider. When the meter is normally used, the slider is held and secured by the meter base and the meter mechanism and fails to be removed, when the coin path is blocked, the shell of the meter mechanism only needs to be taken out from the meter base, and then the slider is slid out from the front panel of the shell of the meter mechanism, thereby clearing the foreign substances in the coin path, with no need of removing the front panel of the shell of the meter in the prior art. In addition, since the coin path is relatively wide, the coin path may be cleared from the front of the front panel of the shell of the meter mechanism. Therefore, the clearing of the coin path is very convenient, which effectively ensure normal working of the meter. The slider is made from plastics easily subjected to injection molding, wherein the manufacture is convenient and the cost is low. Meanwhile, a metal block is configured to mate with the clip groove, and the coin slot is arranged on the metal block to mate with the metal coins, thereby improving the abrasive resistance of the coin slot structure. By the design of the U shape at the tail portion of the slider lower section and the bumps thereon, a bayonet arranged on the side wall at the tail portion of the sliding groove mates with the bump, which facilitates the securing of the slider.

2. The card insertion opening of the POS machine of the meter is provided with a protection door structure, which implements protection of the card insertion opening of the POS machine of the meter, thereby preventing the card insertion opening from rain, dust and foreign substances and ensuring normal use of the meter in terms of card swiping payment. The lower end face of the block at the lower end of the protection door is an inverted triangle bevel or a circular arc surface, which facilitates insertion and removing of the card.

3. A battery baffle that may be movably placed or removed is used, and a guiding groove is designed such that the battery baffle may slide into the groove to press and hold the battery inside the battery holder, with no need of screw off or screw on the screw on the cover plate of the batter holder by using a tool. Therefore, the installation and replacement of the battery are convenient, with no need of preserving a relatively great operation space, thereby achieving a compact structure of the meter. An inner side face of the holding portion of the battery baffle is an arc surface, which better mates with the battery. As such, the abutting and contact area is large, and the stability is good.

DETAILED DESCRIPTION

The present invention is further described with reference to preferred embodiments as illustrated in the accompanying drawings.

Figure 1:
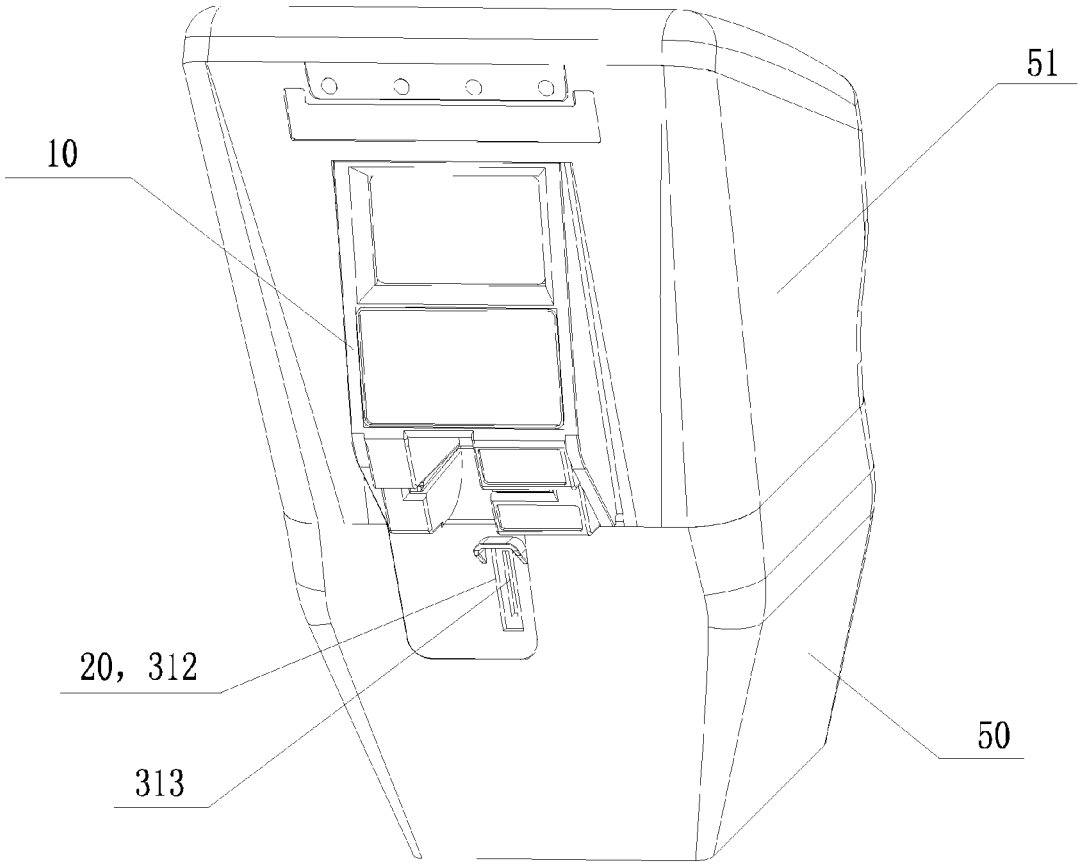
FIG. 1 is a three-dimensional view showing appearance of a parking meter according to the present invention.
Figure 2:
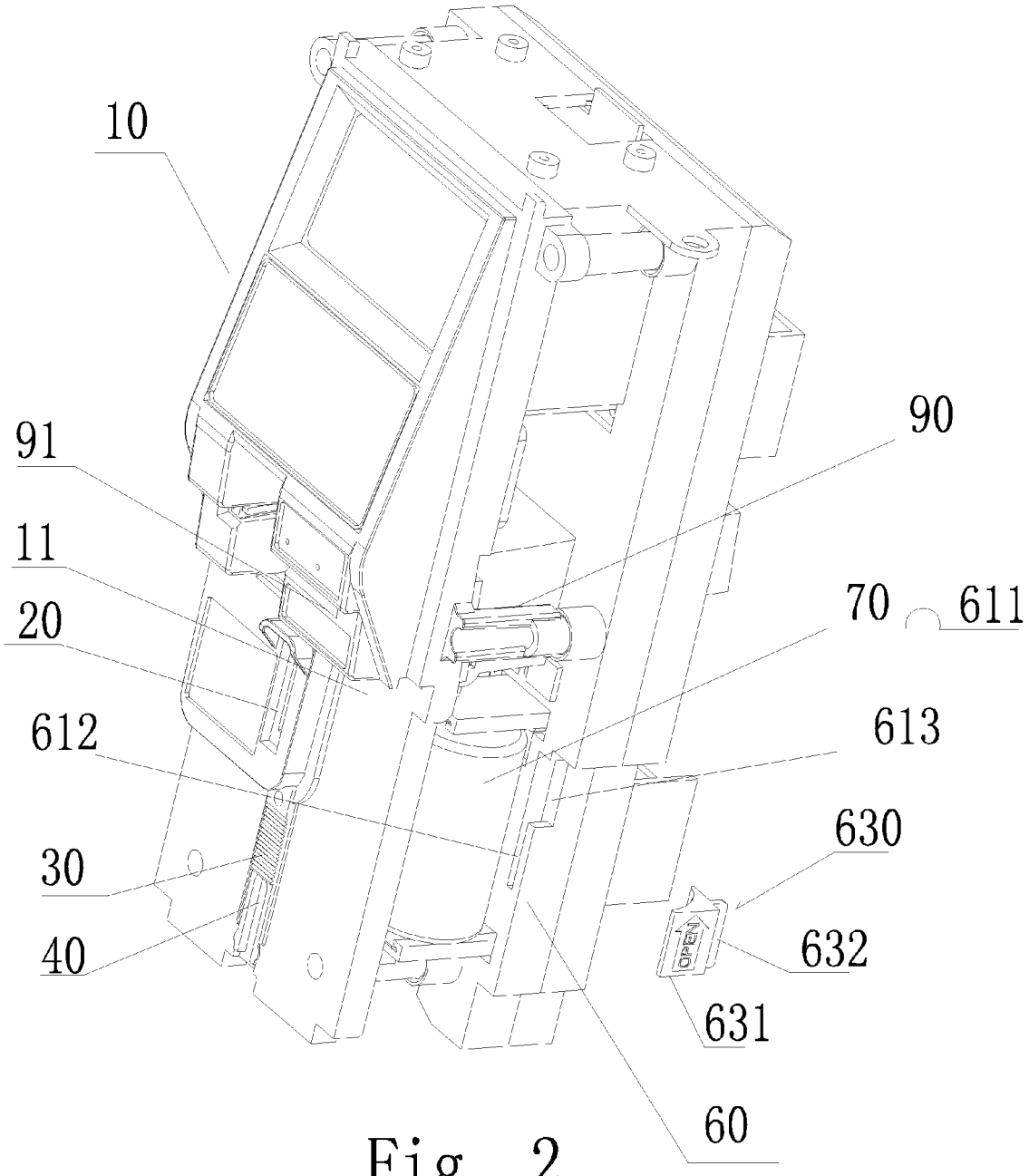
FIG. 2 is a three-dimensional schematic structural view of a meter mechanism of the parking meter according to the present invention (when the meter cover is removed)
Figure 3:
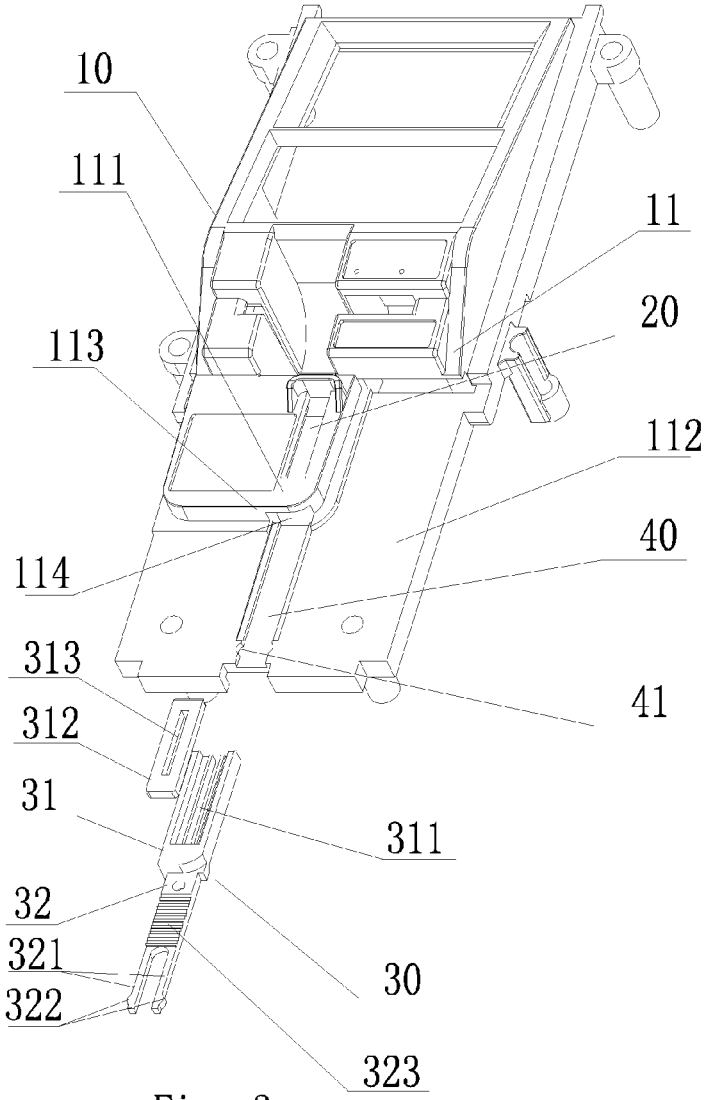
FIG. 3 is a three-dimension explosive schematic view of a front panel of a shell of the meter mechanism according to the present invention.

A parking meter according to the present invention, as illustrated in FIG. 1 and FIG. 2, comprises a meter base 50, a meter cover 51, and a meter mechanism 10 and a POS machine 90 installed inside the meter base 50 and the meter cover 51.

As illustrated in FIG. 3 to FIG. 6, a coin path 20 is provided at a lower section of a front panel 11 of a shell of the meter mechanism 10, the lower section of the front panel 11 comprising a first panel 112 and a second panel 111 in a step form, the first panel 111 protruding relative to the second panel 112, the coin path 20 being provided on the first panel 111; the parking meter further comprises a slider 30, the slider 30 comprising a slider upper section 31 and a slider lower section 32 in a step form; wherein a through hole 113 facilitating passing through of the slider 30 is provided on a joint wall 114 of the first panel 112 and the second panel 111 and below the coin path 20; a sliding groove 40 facilitating upward and downward sliding of the slider 30 is provided on the second panel 112; a coin slot 313 is provided on the slider upper section 31, the slider upper section 31 mates with the coin path 20, and the slider lower section 32 mates with the sliding groove 40; when the meter is assembled, the joint wall 13 is abutted against an upper end face of the meter base 50, the slider lower section 32 and the sliding groove 40 are inside the meter base 50.

Figure 4:
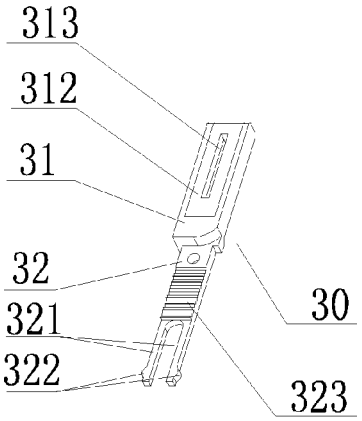
FIG. 4 is a three-dimensional structural schematic view of a slider according to the present invention.

As illustrated in FIG. 4, for ease of manufacture and cost saving, the slider 30 is formed from plastics by injecting molding. Considering the friction caused by coin insertion to the coin path, to improve the abrasive resistance of the coin path, a clip slot 311 is provided on the slider upper section 31, wherein a metal block 312 is installed in the clip slot 311, and the coin slot 313 is provided in the metal block 312. Nevertheless, if factors such as the cost and manufacture are not considered, the slider 30 may be entirely made from metals; or if the abrasive resistance of the coin slot 313 on the slider 30 is not considered, the slider 30 may be entirely made from plastics by injection molding. However, in these two cases, there is no need to provide the clip slot 311 and configure the metal block 312.

As illustrated in FIG. 3 to FIG. 6, a tail portion of the slider lower section is in a U shape, bumps 322 being formed on outer sides of two feet 321 of the U shape; and correspondingly, and a bayonet 41 mating with the bump 322 is formed on a side wall of a tail portion of the sliding groove 40, the bayonet 41 on the side wall of the tail portion of the sliding groove 40 mating with the bumps 322, thereby facilitating securing of the slider 30. For ease of the sliding operation of the slider 30, wave teeth 323 are formed on the slider lower section 32. Hereinafter, with reference to FIG. 1 to FIG. 6, the parking meter and the coil slot of the parking meter according to the present invention are described in detail in terms of assembly and clearance of the coin slot.

Figure 5:
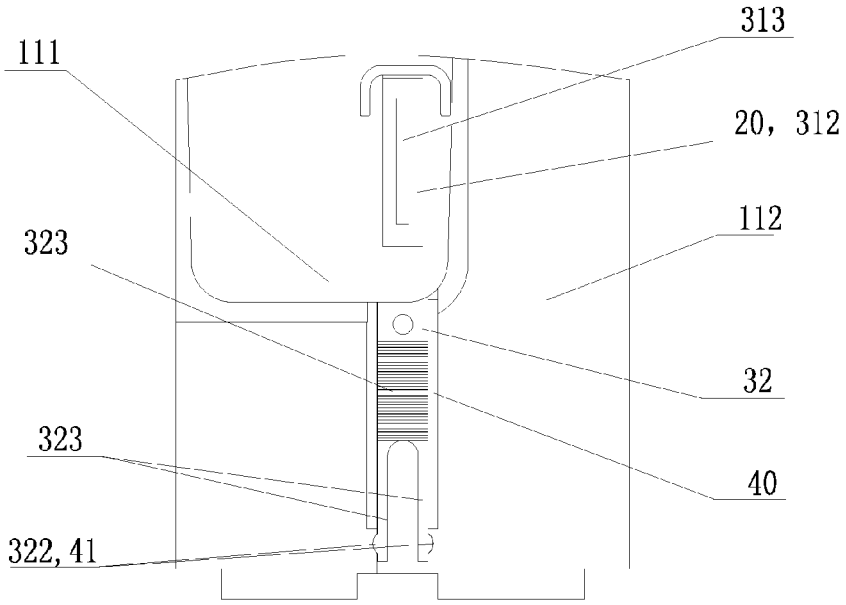
FIG. 5 is a schematic front view of the slider and the front panel of the shell of the meter mechanism when the slider is clipped and held, that is, in the normal working state of the meter according to the present invention.

During assembly, as illustrated in FIG. 5, the slider upper section 31 is upwardly slid into the coin path 20, the slider lower section 32 is clipped in the sliding groove 40, the bumps 322 on the outer side of the two feet 321 of the U shape are respectively clipped into the bayonets 41 on the side wall of the tail portion of the sliding groove; then a lower portion of the entire parking meter body that has been assembled is clipped into the meter base 50. In this case, a hinge wall 113 of the first panel 111 and the second panel 112, together with the step-like end face of the slider upper section 31 abut against the upper face of the meter base 50, the slider lower section 32 and the sliding groove 40 are disposed in the meter base 50; and finally, the cover 51 is placed, and the assembly is completed. The three-dimensional appearance of the assembled parking meter is as illustrated in FIG. 1.

Figure 6:
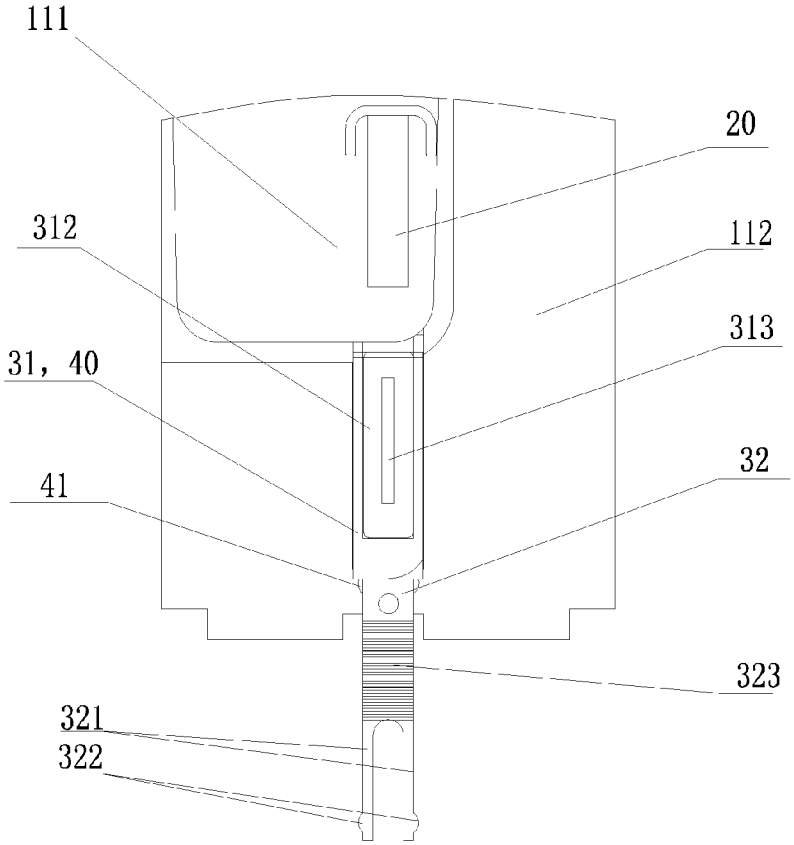
FIG. 6 is a schematic front view of the slider and the front panel of the shell of the meter mechanism when the slider slides out, that is, when the blocking foreign substances in the coin path need to be cleared according to the present invention.
Figure 7:
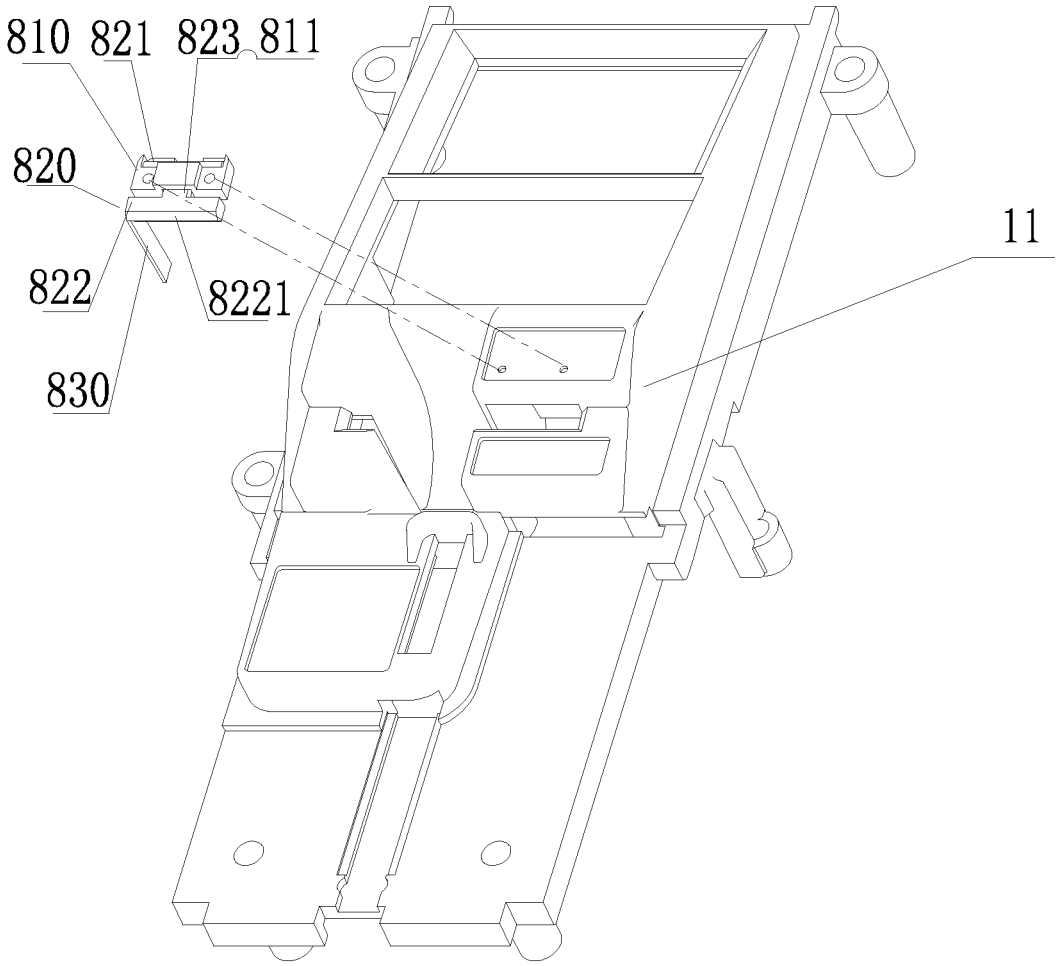
FIG. 7 is a three-dimension explosive schematic view of the front panel of the shell of the meter mechanism and the protection door structure according to the present invention.
Figure 8:
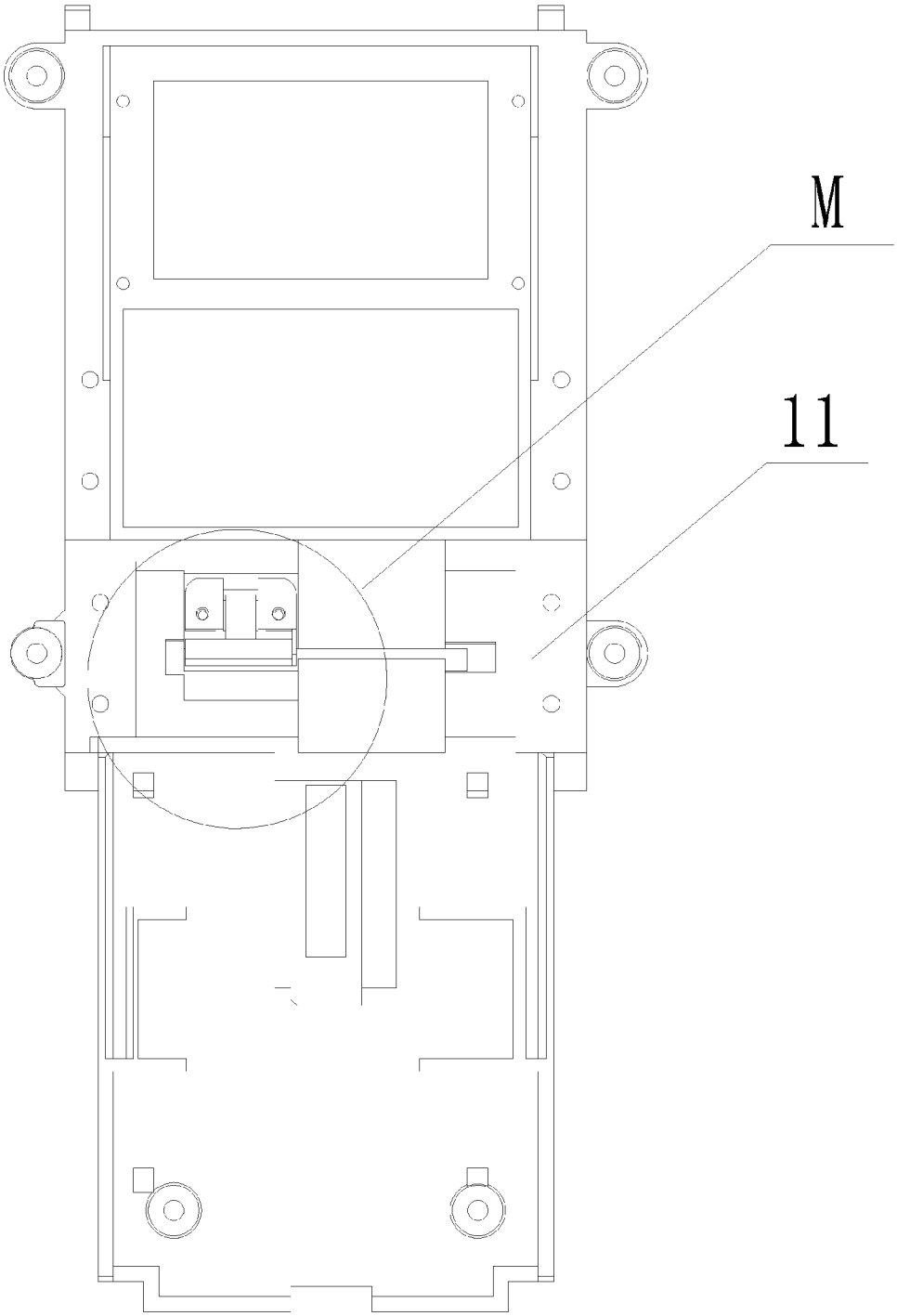
FIG. 8 is a schematic rear view of the front panel of the shell of the meter mechanism of the protection door structure according to the present invention.
Figure 9:
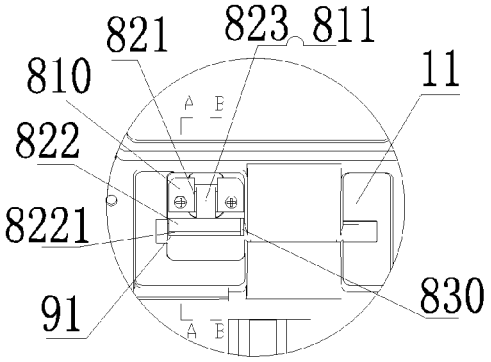
FIG. 9 is a schematic view of enlargement of M in FIG. 8.
Figure 10:
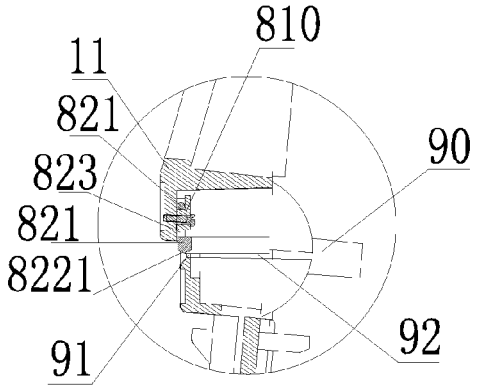
FIG. 10 is an A-A sectional view in FIG. 9.
Figure 11:
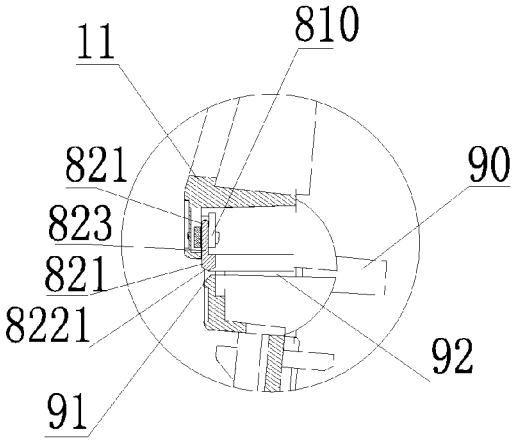
FIG. 11 is a B-B sectional view in FIG. 9.

When the coin path of the meter is blocked and needs to be cleared, the cover 51 is firstly removed, and then the meter mechanism is taken out from the meter base 50. With reference to FIG. 5 and FIG. 6, the two feet 321 of the U shape at the tail portion of the slider lower section 32 are pressed, such that the bumps 322 on the outer side of the feet 321 are detached from the clip slot 41. Then, a downward force is applied to cause the slider 30 to slide out from the coin path 20 and the sliding groove 40, reaching a state as illustrated in FIG. 4. In this case, the coin slot 313 on the slider 30 may be cleared, and meanwhile, since the coin path 20 is relatively wide, the coin path 20 may be directly cleared.

As illustrated in FIG. 7 to FIG. 11, the parking meter according to the present invention further comprises a protection door structure 80 for protecting a card insertion opening 91 of a POS machine 90, the protection door structure 80 comprising an installation base 810, a protection door 820, and a guiding plate 830; wherein the installation base 810 is in a square arch shape, is installed and secured on the front panel 11 of the shell of the meter mechanism 10, and is positioned above the card insertion opening 91; the protection door 823 is in an H shape, and comprises an upper shaft rod 820 and a lower block 821, and an intermediate section 820; the upper shaft rod 820 of the protection door 823 is freely disposed at a top portion of the installation base 810; the intermediate section 821 of the protection door is positioned inside an square arch 810 of the installation base 811, and the length of the intermediate section 830 is greater than the width of the square arch 811 in a top-bottom direction; the guiding plate 822 is parallel with a length direction of a card insertion slot 92 of the POS machine 90, one end of the guiding plate 830 is secured on a lateral side of the protection door 820, and the other end of the guiding plate 823 extends into the interior of the meter; and the protection door 820 is capable of moving in a top-bottom direction and rotating in an inner-outer direction relative to the installation base 810, and the lower block 830 of the protection door 820 is capable of blocking the card insertion opening 91.

During assembly, the protection door 820 (provided with the guiding plate 830) is firstly made to align with the position corresponding to the front panel of the shell of the meter mechanism 10, square arch 811 of the installation base 810 is made to align with the intermediate section 832 of the protection door 820, and then the installation base 810 is secured on the front panel 11 via screws. In this case, the upper end shaft rod 821 of the protection door 820 is disposed at the top portion of the installation base 810, and is clipped and held between an inner wall extending from the top portion of the installation base 810 and the front panel 11. Therefore, the protection door 820 is capable of moving in a top-bottom direction and rotating in an inner-outer direction relative to the installation base 10.

When a car owner swipes the card for payment, the card is inserted along an outer inclined surface of the lower end face 8221 of the block 822 into the card insertion slot 91, the protection door 820 moves upwards and rotates slightly, the card is continuously inserted into the card insertion slot 92, the card moves forwards along the guiding plate 830 (and is pressed against by the guiding plate 830) until the card is inserted into a suitable position, and hence the payment operations of the user are complete. When the card is removed, the card slides out along the inner inclined surface of the lower end face 8221 of the block 822, and the user completely removes the card. Under the gravity of the guiding plate 830, the protection door moves downwards and slightly rotates, until the lower block 822 blocks the card insertion opening 91, thereby achieving the protection effect.

It should be noted that when a lower end face 8221 of the lower block 822 of the protection door 820 is designed to an inverted triangle bevel or a circular arc surface, when the card is inserted or removed, the protection door 820 may be moved upwards with the hand, and the protection door 820 may fall back under the action of the gravity thereof.

Figure 12:
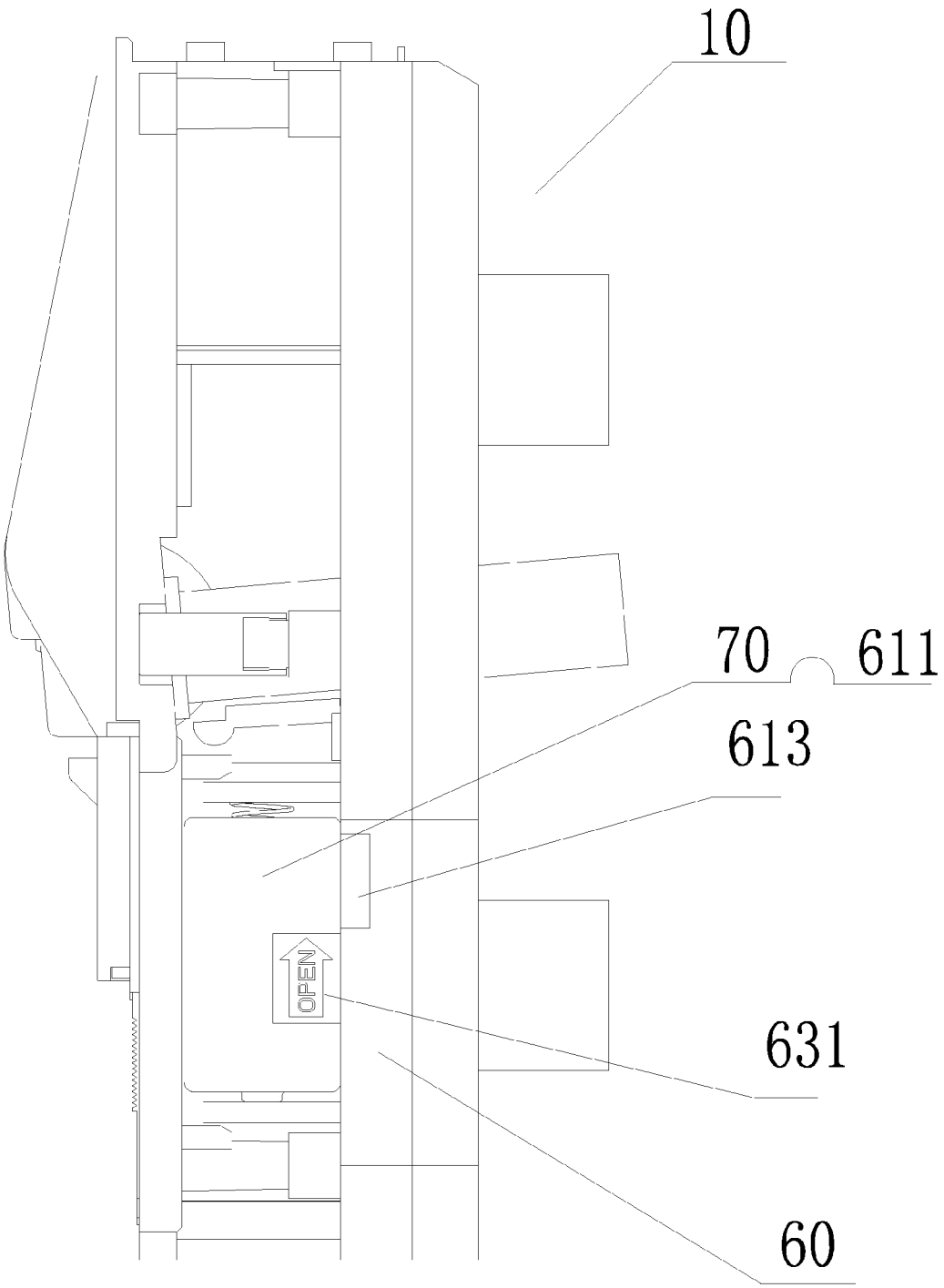
FIG. 12 is a right schematic view of the meter mechanism (when the cover of the meter is removed) according to the present invention.
Figure 13:
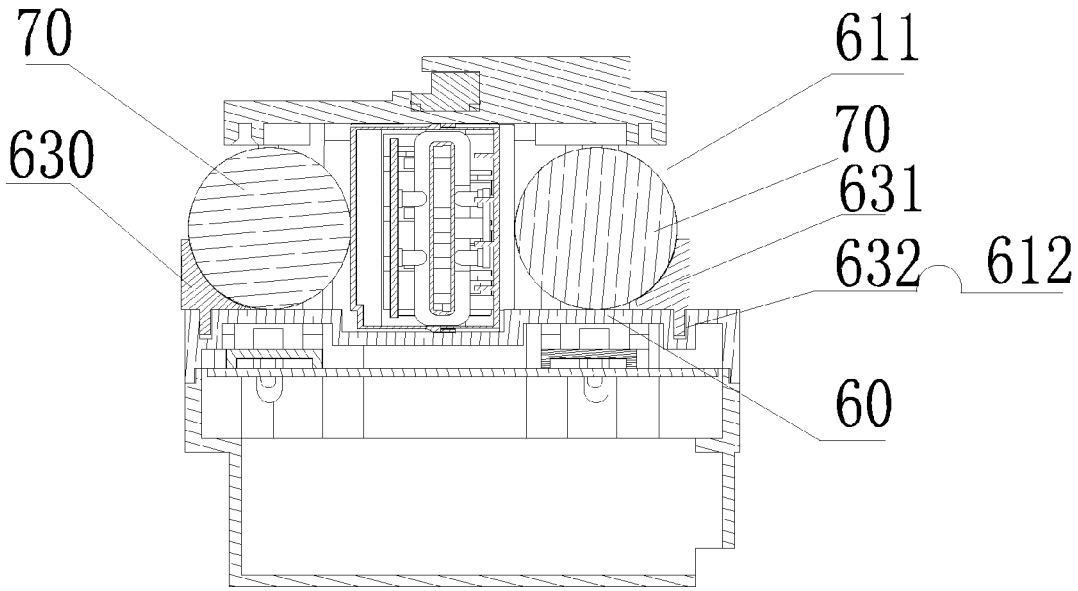
FIG. 13 is a schematic view of a transversely sectional structure of the parking meter according to the present invention.
Figure 14:
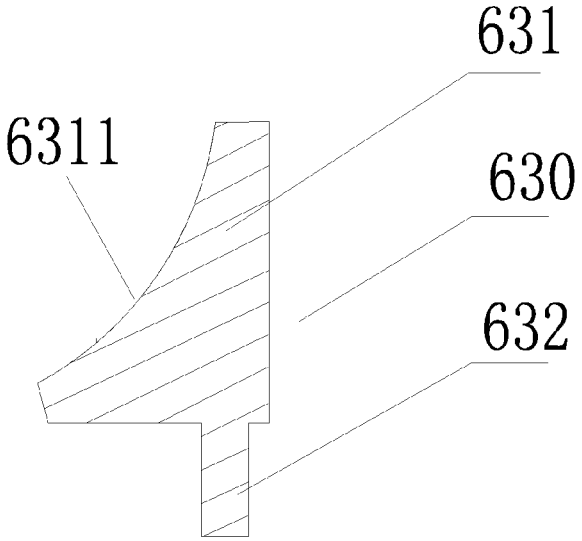
FIG. 14 is a schematic view of enlargement of the sectional structure of a battery baffle according to the present invention.

As illustrated in FIG. 12 to FIG. 14, the parking meter according to the present invention further comprises a battery holder 60 disposed inside the meter, a columnar battery 70 being installed in the battery holder 60, the battery holder 60 being provided with an opening 611 for disposing or removing the battery 70 and being provided with a battery baffle 630, the battery baffle 631 further comprises an upper holding portion 632 and a lower guiding rail portion 630; wherein a thick-wall portion of the battery holder at a side portion of the opening 611 is provided with a guiding groove 612 mating with the guiding rail portion 632, a battery holder wall at a distal end of the guiding groove 612 being provided with a gap 613 for disposing or removing the battery baffle 630; and the guiding rail portion 632 of the battery baffle 630 is slidably clamped in the guiding groove 612, the holding portion 631 of the battery baffle 630 presses and holds the battery 70 inside the battery holder 60.

As illustrated in FIG. 12 and FIG. 13, according to the present invention, the long side direction of the battery holder 60, i.e., the axial direction of the battery 70, is a vertical direction; the guiding groove 612 is parallel with the axial direction of the battery 70; the gap 613 is disposed at an upper distal end of the guiding groove 612; after the battery 70 is disposed into the battery holder 60, the battery baffle 630 is placed from the gap 613 at the upper end of the guiding groove 612, and then the guiding rail portion 632 of the battery baffle 630 slides downwards into the guiding groove 612; the lower end of the guiding groove 612 is slightly lower than the intermediate position of the battery 70. As such, it is ensured that when the battery baffle 630 slides to reach the terminal, the battery baffle 630 still abuts against the intermediate area of the battery 70, thereby achieving good stability. As illustrated in FIG. 14, an inner side face of the holding portion 631 of the battery baffle 630 is an arc surface, which mates with the cylindrical surface of the battery 70. In the present invention, the area of the battery baffle 630 may be made far less than the area of the opening 611 of the battery holder 60. In addition, the design of the arc surface of the inner side face enables the holding portion 631 of the battery baffle 630 to abut against the battery 70 tightly, thereby improving stability.

Detailed above is further description of the present invention with reference to some preferred embodiments, and is not intended to limit the scope of the present disclosure in terms of implementation. Persons of ordinary skill in the art shall understand that other simple deductions and replacements may be made without departing from the inventive concept of the present invention. Such deductions and replacements shall be deemed as coming within the scope of the present invention.

What is claimed is:

1. A parking meter, comprising a meter base, a meter cover, and a meter mechanism installed inside the meter base and the meter cover, wherein a coin path is provided at a lower section of a front panel of a shell of the meter mechanism, the lower section of the front panel comprising a first panel and a second panel in a step form, the first panel protruding relative to the second panel, the coin path being provided on the first panel;

wherein the parking meter further comprises a slider, the slider comprising a slider upper section and a slider lower section in a step form;

wherein a through hole facilitating passing through of the slider is provided on a joint wall of the first panel and the second panel and below the coin path; a sliding groove facilitating upward and downward sliding of the slider is provided on the second panel; a coin slot is provided on the slider upper section, the slider upper section mates with the coin path, and the slider lower section mates with the sliding groove; and when the meter is assembled, the joint wall is abutted against an upper end face of the meter base, the slider lower section and the sliding groove are inside the meter base.

2. The parking meter according to claim 1, wherein a tail portion of the slider lower section is in a U shape, bumps being formed on outer sides of two feet of the U shape; and a bayonet mating with the bump is formed on a side wall of a tail portion of the sliding groove.

3. The parking meter according to claim 1, wherein wave teeth are formed on the slider lower section.

4. The parking meter according to claim 1, further comprising a protection door structure for protecting a card insertion opening of a POS machine, the protection door structure comprising:

an installation base, a protection door, and a guiding plate;

wherein the installation base is in a square arch shape, is installed and secured on the front panel of the shell of the meter mechanism, and is positioned above the card insertion opening;

wherein the protection door is in an H shape, and comprises an upper shaft rod and a lower block, and an intermediate section; the upper shaft rod of the protection door is freely disposed at a top portion of the installation base; the intermediate section of the protection door is positioned inside an square arch of the installation base, and the length of the intermediate section is greater than the width of the square arch in a top-bottom direction;

wherein the guiding plate is parallel with a length direction of a card insertion slot of the POS machine, one end of the guiding plate is secured on a lateral side of the protection door, and the other end of the guiding plate extends into the interior of the meter; and wherein the protection door is capable of moving in a top-bottom direction and rotating in an inner-outer direction relative to the installation base, and the lower block of the protection door is capable of blocking the card insertion opening.

5. The parking meter according to claim 4, wherein a lower end face of the lower block of the protection door is an inverted triangle bevel or a circular arc surface.

6. The parking meter according to claim 1, further comprising:

a battery holder disposed inside the meter, a columnar battery being installed in the battery holder, wherein the battery holder is provided with an opening for disposing or removing the battery and is provided with a battery baffle, the battery baffle further comprising an upper holding portion and a lower guiding rail portion;

wherein a thick-wall portion of the battery holder at a side portion of the opening is provided with a guiding groove mating with the guiding rail portion, a battery holder wall at a distal end of the guiding groove being provided with a gap for disposing or removing the battery baffle; and the guiding rail portion of the battery baffle is slidably clamped in the guiding groove, the holding portion of the battery baffle presses and holds the battery inside the battery holder.

7. The parking meter according to claim 6, wherein the guiding groove is parallel with an axial direction of the battery; and an inner side face of the holding portion of the battery baffle is an arc surface, which mates with a cylindrical surface of the battery.

8. The parking meter according to claim 7, wherein the gap is provided on an upper end of the guiding groove.

9. The parking meter according to claim 1, wherein the slider is made from plastic, and a clip slot is provided on the slider upper section;

wherein a metal block is installed in the clip slot, and the coin slot is provided in the metal block.

10. The parking meter according to claim 9, wherein a tail portion of the slider lower section is in a U shape, bumps being formed on outer sides of two feet of the U shape; and a bayonet mating with the bump is formed on a side wall of a tail portion of the sliding groove.

11. The parking meter according to claim 9, wherein wave teeth are formed on the slider lower section.

12. The parking meter according to claim 9, further comprising a protection door structure for protecting a card insertion opening of a POS machine, the protection door structure comprising an installation base, a protection door, and a guiding plate;

wherein the installation base is in a square arch shape, is installed and secured on the front panel of the shell of the meter mechanism, and is positioned above the card insertion opening;

wherein the protection door is in an H shape, and comprises an upper shaft rod and a lower block, and an intermediate section; the upper shaft rod of the protection door is freely disposed at a top portion of the installation base; the intermediate section of the protection door is positioned inside an square arch of the installation base, and the length of the intermediate section is greater than the width of the square arch in a top-bottom direction;

wherein the guiding plate is parallel with a length direction of a card insertion slot of the POS machine, one end of the guiding plate is secured on a lateral side of the protection door, and the other end of the guiding plate extends into the interior of the meter; and wherein the protection door is capable of moving in a top-bottom direction and rotating in an inner-outer direction relative to the installation base, and the lower block of the protection door is capable of blocking the card insertion opening.

13. The parking meter according to claim 12, wherein a lower end face of the lower block of the protection door is an inverted triangle bevel or a circular arc surface.

14. The parking meter according to claim 9, further comprising:

a battery holder disposed inside the meter, a columnar battery being installed in the battery holder, wherein the battery holder is provided with an opening for disposing or removing the battery and is provided with a battery baffle, the battery baffle further comprising an upper holding portion and a lower guiding rail portion;

wherein a thick-wall portion of the battery holder at a side portion of the opening is provided with a guiding groove mating with the guiding rail portion, a battery holder wall at a distal end of the guiding groove being provided with a gap for disposing or removing the battery baffle; and the guiding rail portion of the battery baffle is slidably clamped in the guiding groove, the holding portion of the battery baffle presses and holds the battery inside the battery holder.

15. The parking meter according to claim 14, wherein the guiding groove is parallel with an axial direction of the battery; and an inner side face of the holding portion of the battery baffle is an arc surface, which mates with a cylindrical surface of the battery.

16. The parking meter according to claim 15, wherein the gap is provided on an upper end of the guiding groove.

* * * * *